US009291342B2

(12) United States Patent
Kramer et al.

(10) Patent No.: US 9,291,342 B2
(45) Date of Patent: Mar. 22, 2016

(54) ARRANGEMENT FOR INFLUENCING AN EXHAUST GAS FLOW

(75) Inventors: Walter Kramer, Rotterdam (NL); Wim Stijger, Noordwijk (NL); Raymond Johannes Josephus Gunnewijk, Alphen aan der Rijn (NL); Uwe Hensch, Marienheide (DE)

(73) Assignee: NEM POWER-SYSTEMS, Recklinghausen (DE)

( * ) Notice: Subject to any disclaimer, the term of this patent is extended or adjusted under 35 U.S.C. 154(b) by 961 days.

(21) Appl. No.: 13/510,765

(22) PCT Filed: Nov. 18, 2010

(86) PCT No.: PCT/EP2010/007014
§ 371 (c)(1),
(2), (4) Date: Jul. 11, 2012

(87) PCT Pub. No.: WO2011/060935
PCT Pub. Date: May 26, 2011

(65) Prior Publication Data
US 2012/0279596 A1 Nov. 8, 2012

(30) Foreign Application Priority Data
Nov. 19, 2009 (EP) ..... 09014442

(51) Int. Cl.
*F22B 37/24* (2006.01)
*F22B 1/18* (2006.01)
*F01D 25/30* (2006.01)
*F28F 9/02* (2006.01)

(52) U.S. Cl.
CPC ..... *F22B 1/1815* (2013.01); *F01D 25/30* (2013.01); *F22B 37/24* (2013.01); *F28F 9/028* (2013.01)

(58) Field of Classification Search
CPC ..... F01D 25/30; F22B 1/1815; F22B 37/24; F28F 9/026; F28F 9/028
See application file for complete search history.

(56) References Cited

U.S. PATENT DOCUMENTS

| | | | | | |
|---|---|---|---|---|---|
| 2,230,221 | A * | 2/1941 | Fitch | F28F 21/04 | 122/155.2 |
| 3,442,324 | A * | 5/1969 | Clay, Jr. | F22B 1/1815 | 122/7 R |
| 4,427,058 | A * | 1/1984 | Bell, Sr. | F22B 1/1869 | 122/155.2 |
| 4,573,551 | A * | 3/1986 | Schwerdtner | F15D 1/04 | 181/218 |
| 4,685,426 | A * | 8/1987 | Kidaloski et al. | 122/214 | |
| 4,919,169 | A * | 4/1990 | Bachmann et al. | 137/875 | |
| 5,299,601 | A * | 4/1994 | Koch | 137/875 | |
| 5,431,009 | A * | 7/1995 | Bauver, II | F22B 1/1815 | 122/7 R |
| 5,555,718 | A | 9/1996 | Anderson et al. | | |
| 5,946,901 | A * | 9/1999 | Bauver et al. | 60/39.182 | |
| 6,125,623 | A * | 10/2000 | Cloyd et al. | 60/783 | |
| 6,298,655 | B1 * | 10/2001 | Lee et al. | 60/39.182 | |

(Continued)

FOREIGN PATENT DOCUMENTS

| | | | | |
|---|---|---|---|---|
| DE | 19737507 A1 * | 3/1999 | | F02C 6/18 |
| DE | 19961540 | 12/2000 | | |

(Continued)

*Primary Examiner* — Lorne Meade

(57) ABSTRACT

An arrangement for influencing the flow of an exhaust gas of a gas turbine in a channel that preferably leads to a waste-heat exchanger or boiler. A flow grating is disposed transversely in the channel at an end of the channel that faces the gas turbine. The flow grating partially obstructs the cross-sectional area of the channel, and is provided with passages.

6 Claims, 8 Drawing Sheets

(56) References Cited

U.S. PATENT DOCUMENTS

| | | | | |
|---|---|---|---|---|
| 6,453,852 | B1 * | 9/2002 | Lifshits | F22B 1/1815 122/367.3 |
| 6,851,514 | B2 * | 2/2005 | Han | F22B 1/1815 181/224 |
| 6,919,050 | B2 * | 7/2005 | Hettwer et al. | 422/176 |
| 8,596,227 | B2 * | 12/2013 | Heinrichs | 122/510 |
| 2007/0119388 | A1 * | 5/2007 | Waseda | F22B 1/1815 122/7 R |
| 2011/0048010 | A1 * | 3/2011 | Balcezak et al. | 60/645 |

FOREIGN PATENT DOCUMENTS

| | | |
|---|---|---|
| EP | 0863364 | 9/1998 |
| EP | 1146285 | 10/2001 |
| EP | 2026000 | 2/2009 |
| WO | WO 99/31435 | 6/1999 |
| WO | WO 99/45321 | 9/1999 |

* cited by examiner

ARRANGEMENT FOR INFLUENCING AN EXHAUST GAS FLOW

BACKGROUND OF THE INVENTION

The instant application should be granted the priority dates of Nov. 19, 2009, the filing date of the corresponding European patent application 09014442.9, as well as Nov. 18, 2010, the filing date of the International patent application PCT/EP2010/007014.

The present invention relates to an arrangement for influencing the flow of an exhaust gas of a gas turbine in a channel that preferably leads to a waste-heat exchanger or boiler.

The exhaust gas stream of a gas turbine is typically not supplied to the exhaust gas system as a flow that is uniformly distributed over the entire cross-section of the channel and that has a uniform velocity of the exhaust gas. Depending upon the manufacture and type of gas turbine, or also depending upon loading, a varying velocity distribution exists. The non-uniformly distributed flow can lead to mechanical loading of the unit components disposed in the exhaust gas section. These unit components must have a complicated and/or expensive design, for example with regard to the thickness of the walls, if other measures cannot be made available.

EP 1 146 285 B1 discloses a waste-heat boiler that is supplied with exhaust gas from a gas turbine, with a diverter having a pivotable flap being disposed between the boiler and the gas turbine. In order with this arrangement to achieve an evening-out of the distribution of the local gas stratification over the flow cross-section of the waste-heat boiler, a guide mechanism is disposed downstream of the pivotable flap. The baffles of this guide mechanism are pivotable between a deflection position during the conveyance to the waste-heat boiler, and a position that does not influence the gas flow.

It is an object of the present application to provide an arrangement to protect the waste-heat boiler of a gas turbine unit and/or components that might be disposed in the channel that conveys exhaust gas from damage caused by flow forces from flows having locally increased velocities.

SUMMARY OF THE INVENTION

This object is inventively realized for an arrangement of the aforementioned general type by disposing a flow grating transversely in the channel at an end of the channel that faces the pas turbine, wherein the flow crating partially obstructs the cross-sectional area of the channel, and wherein the flow grating is provided with passages.

The flow grating of the present application is partially gas impermeable, and is embodied in such a way that the flow is altered in an intentional or defined manner. The exhaust gas stratification having increased velocity is slowed down, and the flow velocity is evened out over the cross-sectional area of the channel. The flow grating is installed in the channel of the exhaust gas system in such a way that the evening out of the velocity is effected to an adequate extent, even before the gas stream encounters the downstream components of the unit.

BRIEF DESCRIPTION OF THE DRAWINGS

A number of exemplary embodiments of the invention, which will be explained in greater detail subsequently, are illustrated in the drawing, in which.

DESCRIPTION OF SPECIFIC EMBODIMENTS

Figure 1:
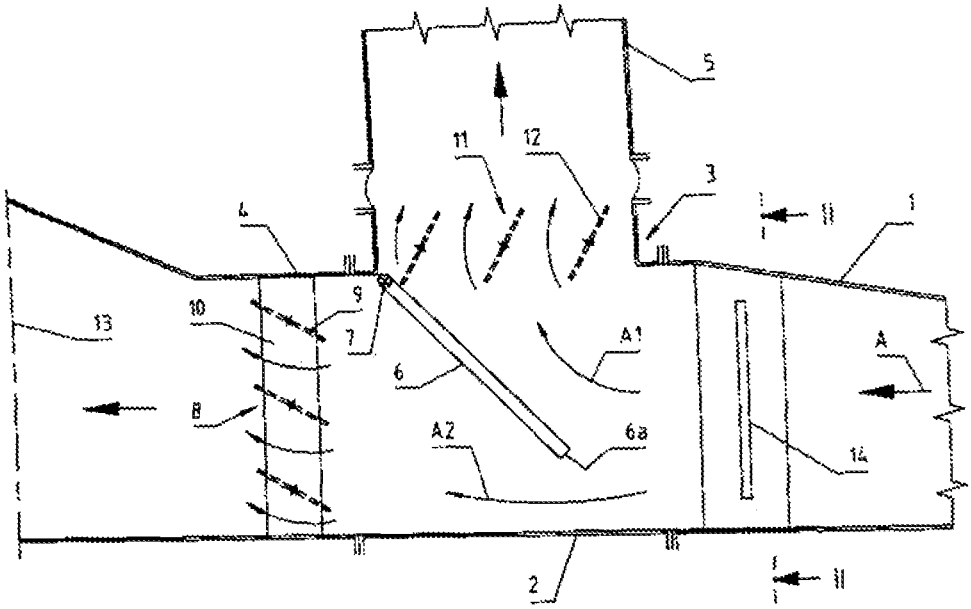
FIG. 1 shows an arrangement for influencing the gas flow in a gas turbine unit having a bypass.

Pursuant to FIG. 1, exhaust gas A is conveyed to a housing 2 of a diverter 3 from a non-illustrated gas turbine via a channel 1. On that side facing away from the channel 1 the diverter 3 is connected to a channel 4 that conveys the exhaust gas A to a waste-heat exchanger or boiler, the inlet of which is indicated by the reference numeral 13. Branching off from the housing 2 is a bypass channel 5 that leads to a non-illustrated bypass flue. A pivotable closure means 6 is mounted in the housing 2 of the diverter 3 so as to be pivotable about an axis 7 in such a way that the closure means can block off the channel 4 or the bypass channel 5 while also being able to maintain various intermediate positions. In the position shown in FIG. 1, a portion A1 of the exhaust gas A supplied from the gas turbine enters the bypass channel 5, while another portion A2 flows about the free edge 6*a* of the pivotable closure means 6 and flows to the waste-heat boiler.

When the flow A2 flows about the free edge 6*a* of the pivotable closure means 6, local stratification is formed that under certain circumstances is reinforced by the swirling imparted by the gas turbine. The stratification formation in the flow A2 leads to a non-uniform supply of heat to the cross-sectional area of the channel 4, and hence of the waste-heat boiler.

Disposed in the inlet end of the channel 4 is a guide mechanism 8, which is provided with adjustable baffles 9 that are disposed in a vertical cross-sectional plane. A support 10 can additionally be disposed in the channel 4 for the central mounting of the baffles 9. As can be seen in FIG. 1, the pivot angles of the individual baffles 9 can be set independently of one another in order to be able to better adapt the necessary deflection to the given stratification configuration.

The gas stream A2, for example upon bringing the waste-heat boiler into place, is distributed more uniformly over the cross-sectional area of the channel 4. At the conclusion of the process of bringing the boiler into place, the pivotable closure means 6 blocks the bypass channel 5, and the baffles 9 assume a position in which the gas stream A that is supplied from the gas turbine flows to the waste-heat boiler without deflection in the guide mechanism 8. In this position, the guide mechanism produces no notable pressure loss.

Disposed in the bypass channel 5 is a guide mechanism 11, which is comparable to the guide mechanism 8, and which is provided with baffles 12 that can improve, for example, the flow to a muffler or sound absorber disposed in the bypass channel 5 or the downstream bypass flue. The baffles 12 can be adjustable.

The previously described measures prevent a non-uniform distribution of flow in the channel 4 downstream of the pivotable closure means 6, which results from the inclined position of the closure means. The exhaust gas that leaves the gas turbine, however, already enters the channel 1 with a non-uniform flow distribution over the cross-sectional area of the channel. In this connection, depending upon the type of gas turbine, streams having a higher velocity can occur, for example in the central region of the channel 1.

A flow grating or grid 14, which will be described in detail subsequently, serves to make the flow within the channel 1 that is connected to the gas turbine more uniform, and of reducing the higher velocities. The flow grating can be disposed in conjunction with the guide mechanisms 8 and/or 11; however, it can also be utilized without the guide mechanisms.

Figure 2:
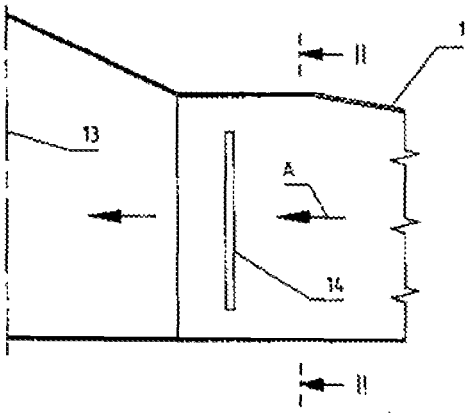
FIG. 2 shows an arrangement for influencing the gas flow in a channel connected directly with the waste-heat boiler.
Figure 3:
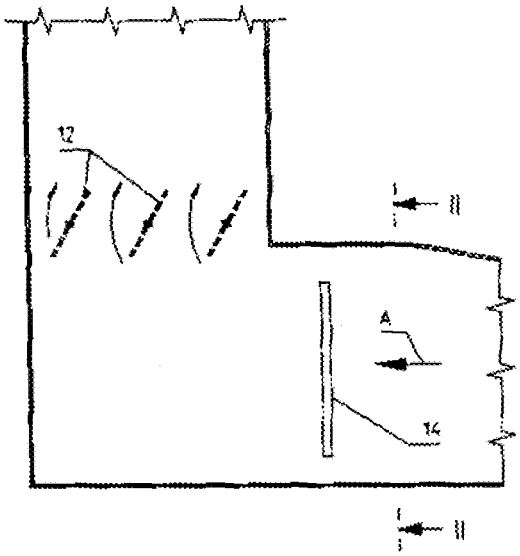
FIG. 3 shows an arrangement for influencing the gas flow in an exhaust gas system having no waste-heat boiler.

The flow grating 14, which is indicated only schematically in FIGS. 1 to 3, is disposed transversely in the channel 1 at the end facing the gas turbine and far enough ahead or upstream of the waste-heat boiler or of the components, such as the pivotable closure means 6. The flow grating 14 is preferably disposed in that region of the channel 1 where the greatest gas velocities are to be expected.

Figure 4:
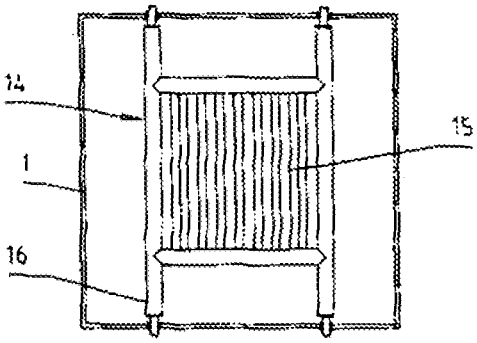
FIG. 4 shows a cross-sectional view taken along the line II-II in FIGS. 1 to 3.

The flow grating 14 is a plate or panel-like, partially gas-impermeable structure that partially obstructs the cross-sectional area of the channel and is provided with openings or passages for the exhaust gas. The flow grating 14 can, as shown in FIG. 4, be comprised of a plurality of pipes or tubes 15 that are spaced from one another and between which gaps for the passage of the exhaust gas are formed. The tubes 15 are interconnected by elements that extend transverse to them, and which can also be tubes 15. One row of tubes 15 can be present within the flow grating 14. However, instead of one row of tubes 15, a plurality of rows of tubes 15, which are disposed one after the other in the direction of flow of the exhaust gas, can also be utilized. In this connection, the tubes 15 of one row are offset relative to the tubes 15 of the following row.

The tubes 15 can be comprised of a heat-resistant or refractory material, and can represent a purely mechanical installation. However, the tubes 15 can also be embodied as internally-cooled elements.

The tubes 15 of the flow grating 14 are held in a support structure 16. The support structure 16 can be supported on the inner or outer hull or jacket of the channel 1, so that the forces generated by the flow of the exhaust gas can be absorbed. Similarly, the expansions of the material that occur due to the operating temperatures are compensated for by the support structure 16.

Figure 5:
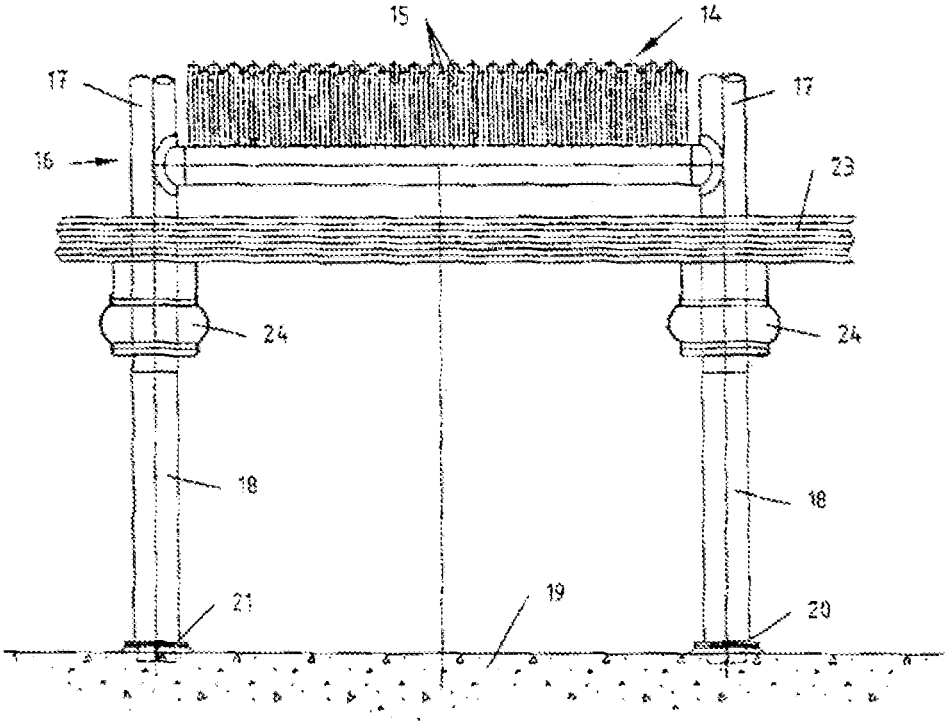
FIG. 5 is a side view of the lower portion of a support structure for a flow grating.
Figure 6:
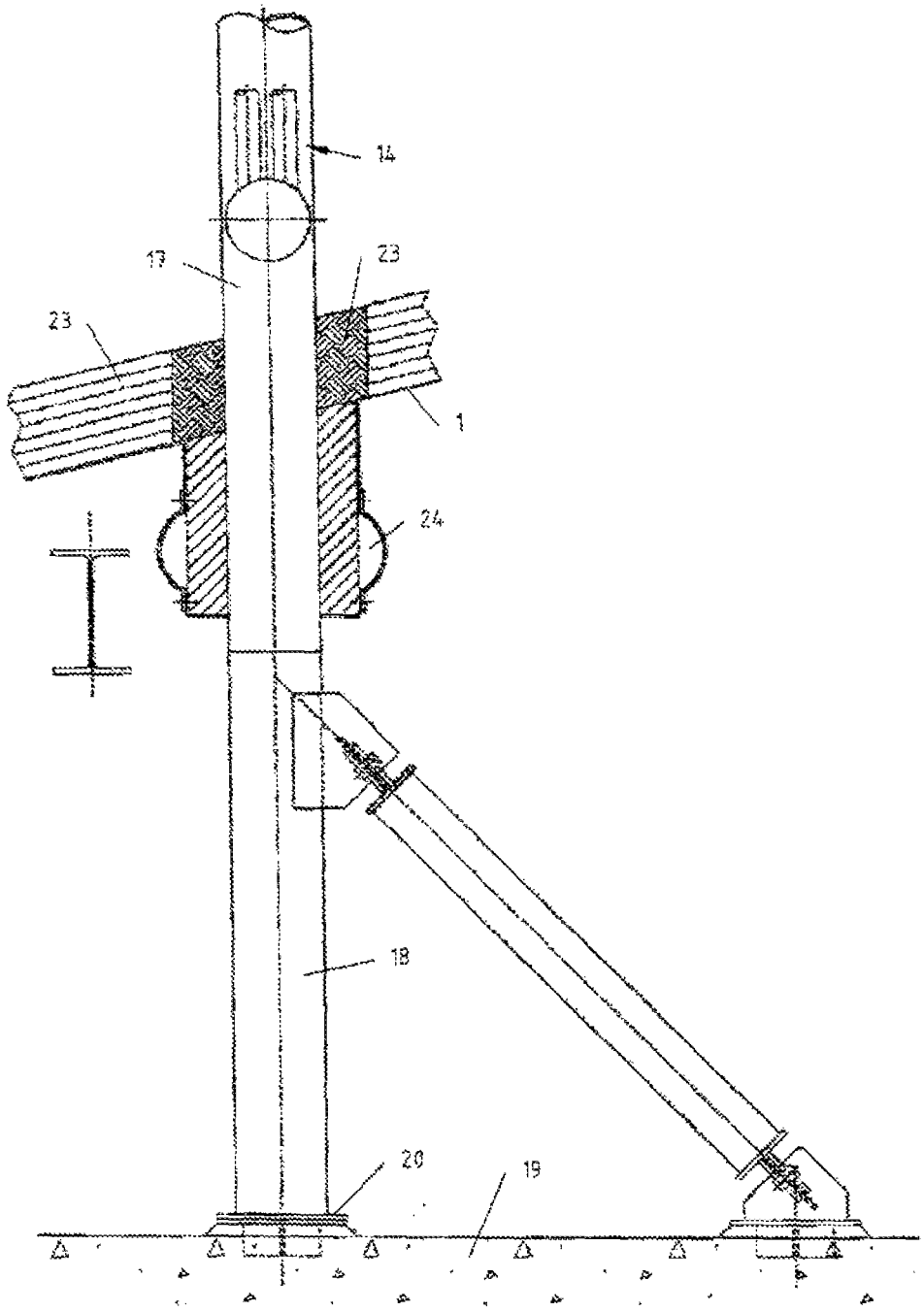
FIG. 6 shows a detail of the support structure having a lower support.
Figure 7:
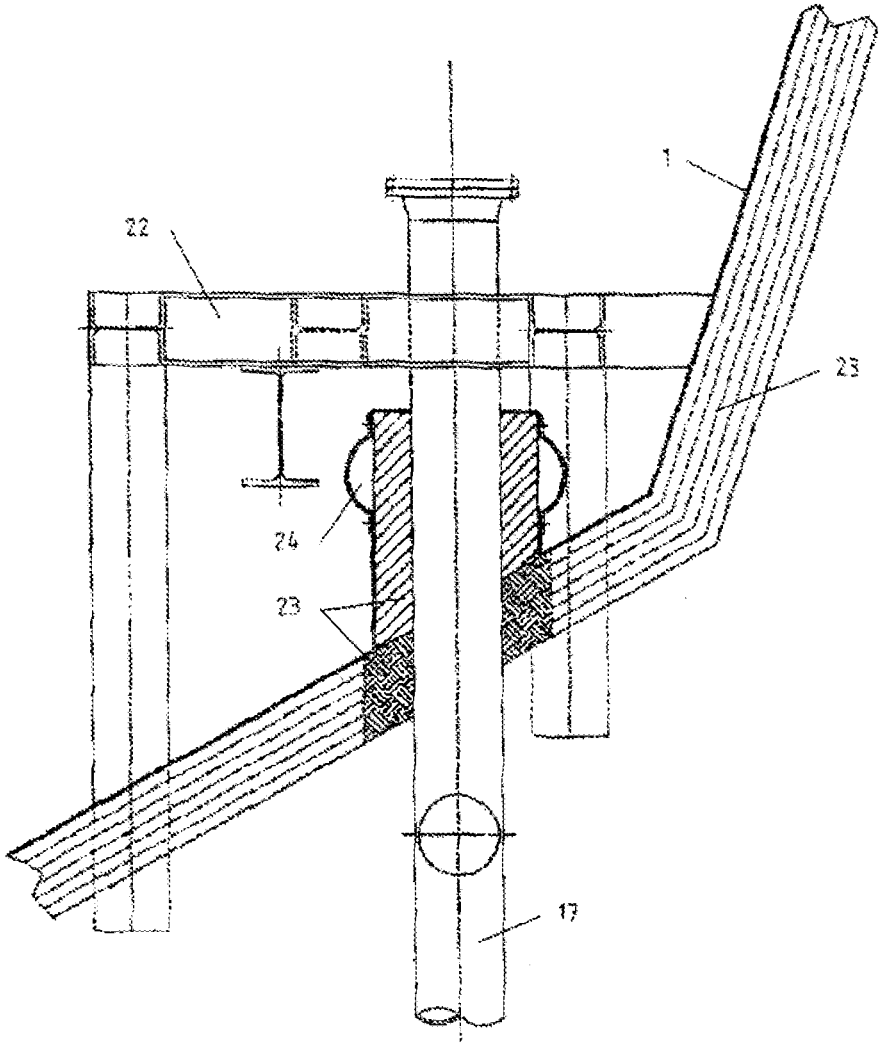
FIG. 7 shows a detail of the support structure having an upper support.

In conformity with FIGS. 5, 6 and 7, the support structure 16 is preferably comprised of vertical support pipes 17 or support rods, which are guided through the wall of the channel 1. On the underside of the channel 1, the support pipes 17 are supported via support pipe extensions 18 in supports 20, 21 on the concrete base or foundation 19 (FIGS. 5 and 6). This is a welded construction that is inherently rigid without gaps. The support 20 shown on the right side in FIG. 5 is embodied as a fixed support, and the support 21 on the left side is embodied as a movable support. Pursuant to FIG. 7, the support of the support pipes 17 is effected on the upper side of the channel 1 via a steel structure 22 disposed thereabove.

The inner wall of the channel 1, as well as the passage region of the support pipes 17, are provided with an insulation 23. The sealing of the support pipe 17 relative to the hot exhaust gases within the channel 1 is effected on the outer side of the channel 1 via compensators 24. With this embodiment, the supports can be inspected from the outside, and can be adjusted during operation of the facility.

Instead of the support structure shown by way of example in FIGS. 5 to 7, other embodiments and designs are also possible within the context of the present application.

Figure 8:
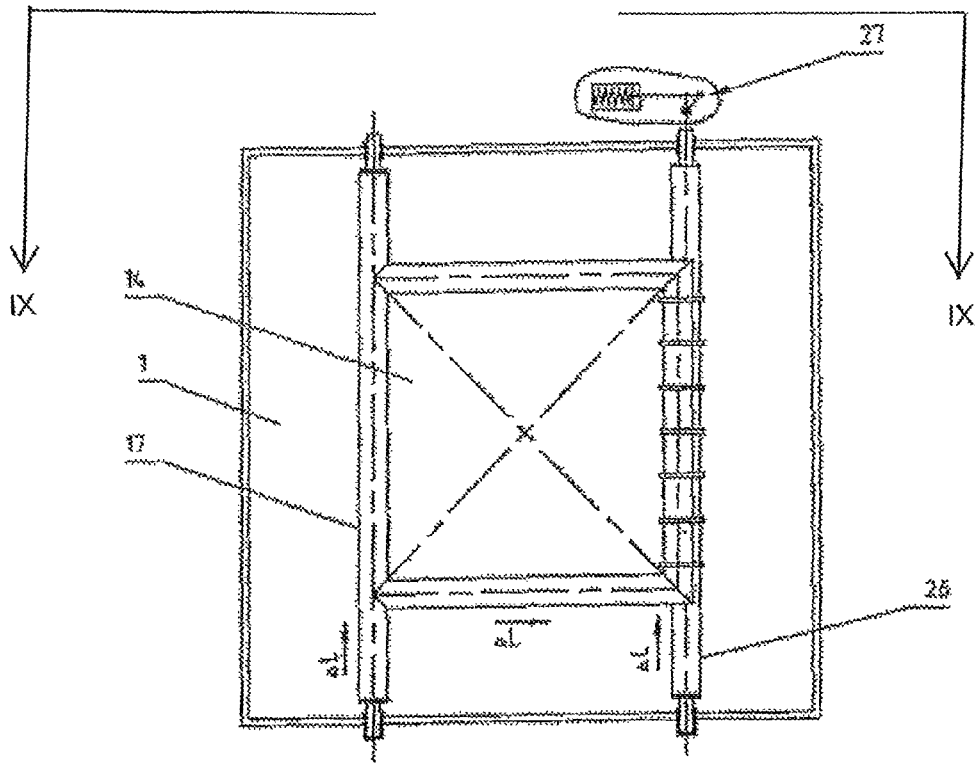
FIG. 8 is a cross-sectional view of another embodiment taken along the line II-II in FIGS. 1 to 3.
Figure 9:
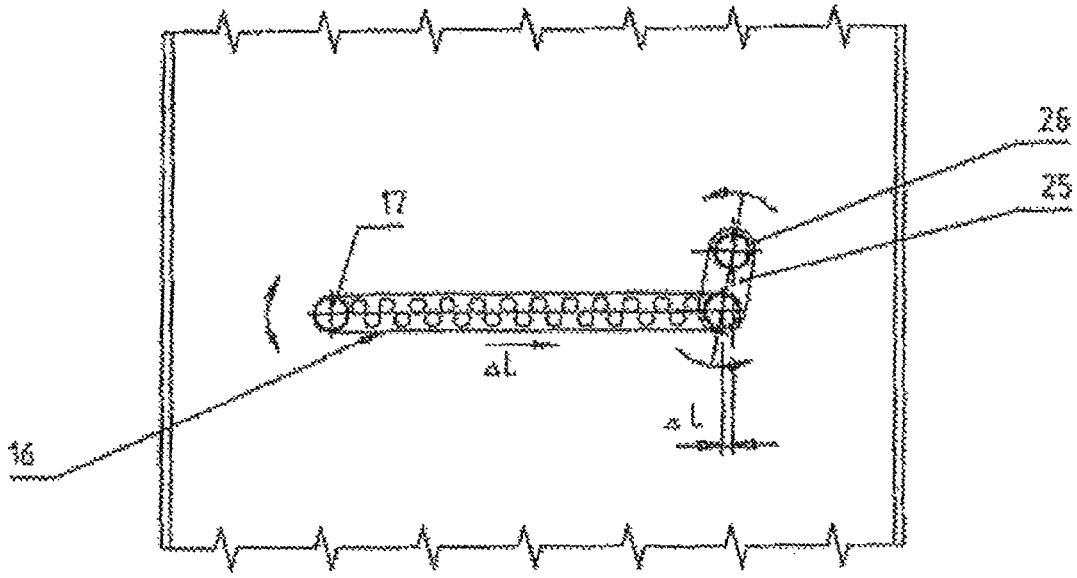
FIG. 9 is a plan view onto the embodiment of FIG. 8.

With the embodiments of FIGS. 8 and 9, the flow grating 14 is a welded structure made of materials having comparable coefficients of thermal expansion. A vertical support pipe 17 or support rod of the support structure 16 is on the one side, at the top and the bottom, secured to the inner or outer hull or jacket of the channel 1 so as to be rotatably mounted. On the other side of the flow grating 14, the support structure 16 is pivotably secured via link members 25 to an additional support 26, which is pivotably mounted on the hull or jacket of the channel 1. The support 26 is positioned in such a way that the thermal differential expansion $\Delta L$ between the flow grating 14 and the channel 1 produces a rotation or pivoting of the support 26. At the top or bottom, the support 26 can be connected to the wall of the channel 1 externally of the channel jacket via an attenuation system 27 (FIG. 8). Such attenuation systems can also be mounted on the support pipe 17.

Instead of tubes 15, rods or similar elongated elements can be used for the flow grating 14. Pursuant to FIG. 4, the tubes 15 are disposed vertically. It is just as possible to orient the tubes 15 or rods horizontally, at an angle, or in a circular or oval manner relative to one another. The important thing is that a partially gas-impermeable flow grating 14 that is provided with passages results.

The flow grating 14 that has been described serves to protect the components that are disposed in the channel 1, such as the pivotable closure means 6 of the diverter 3 shown in FIG. 1, and a non-illustrated exhaust gas muffler that is possibly disposed in the channel 1, which selectively supply the exhaust gas of the gas turbine to the waste-heat boiler or to a bypass channel 5 that bypasses the waste-heat boiler or is disposed parallel thereto. In the absence of such a bypass, a flow grating 14 can advantageously be installed in the channel 1 ahead of the inlet 13 into the waste-heat boiler (See FIG. 2). In this case, the components of the waste-heat boiler are protected by the evening out of the flow distribution, which is effected by the flow grating 14. Finally, the flow grating 14 can also be utilized in an exhaust gas system connected with a gas turbine that is connected neither directly nor via a diverter 3 with a waste-heat boiler (see FIG. 3). Baffles or baffle plates 12 can also additionally be installed in the channel 1 of such an exhaust gas system. Also in this case the flow velocity of the turbine gas is evened out in order to protect the components, for example an exhaust gas muffler, present in the exhaust gas system.

As previously explained, the flow grating is subjected to a permanent mechanical loading from a turbine gas or some other exhaust gas. The loading can be derived from the pressure head of the exhaust gas stream or of some other stream that results from the flow velocity. Furthermore, an induction of vibrations is customarily applied to components within the channel by the exhaust gas stream or some other flow due to cyclical fluctuations in pressure. In this connection, the induction of vibrations has a greatly differing characteristic depending upon the load condition of the unit. To this extent, it is desirable that an arrangement be available for an operationally reliable function for influencing an exhaust gas stream or some other flow without any additional cooling. Finally, an additionally required cooling can be viewed as a source of error, which could lead to breakdown of the entire unit, or would reduce the effectiveness of a downstream utilization of heat. If cooling of the arrangement is provided, at the same time heat must be drawn off, which then can no longer be expediently utilized from a process standpoint.

Figure 10:
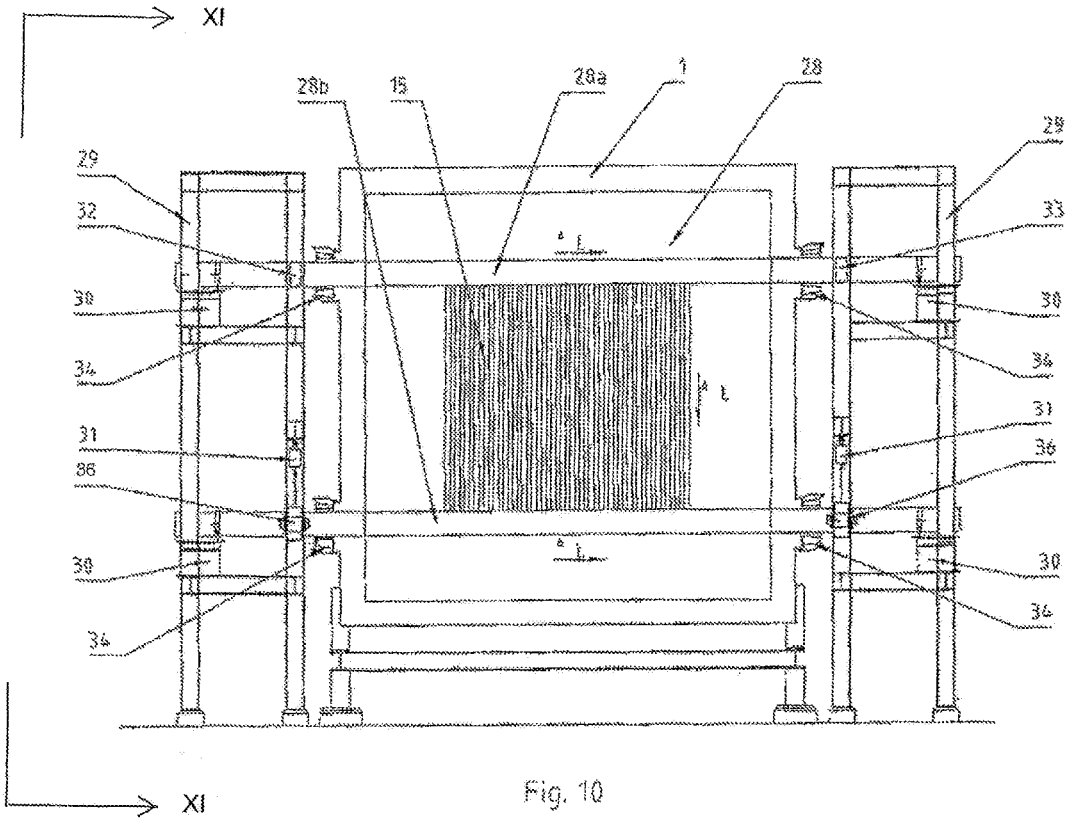
FIG. 10 shows a further exemplary embodiment pursuant to an imaginary section line II-II.

With regard to the described requirements, a further exemplary embodiment shown in FIG. 10 as an arrangement for influencing an exhaust gas stream or other flow has substantially special features in that the embodiment of the flow grating or grid 28, in conjunction with the support structure 29, is constructed such that the flow grating is to be used without an additional cooling. In this connection, to improve the operation or performance of the arrangement, the dynamic loads, which are present to a great extent, are taken care of by using additional devices for the support structure 29, such as vibration dampeners 30 and constant suspensions 31.

In FIG. 10, the flow grating 28 disposed in the channel 1 is embodied as an inherently rigid welded construction. The flow grating 28 has no sliding or shifting locations, or any other compensation for thermal expansion, of the components disposed within the channel 1 about which turbine gas or other exhaust gases flow. Connecting elements 28*a* and 28*b*, which extend transverse to the tubes 15 of the flow grating 28, and which support the tubes, are, via flexible bushings 34 on the channel 1 that are impermeable to flue gas, guided outwardly to the support structures 29 that are respectively disposed on a side of the channel 1.

By means of at least one upper connecting element 28*a* on one side of the channel 1, the flow grating 28 is fixed on a bearing means 32 that is disposed in the support structure 29 so as to be non-displaceable in all directions. On the opposite side of the channel 1, the at least one upper connecting element 28*a* is supported in a bearing means 33 that is disposed in the support structure and that compensates against thermal expansion in the horizontal direction by displacement of the at least one upper connecting element. The mounting of the at least one lower connecting element 28*b* of the flow grating 28 is realized in a bearing means 35 disposed in the support structure on one side of the channel 1, and in a bearing means 36 disposed in the support structure on the opposite side of the channel. The bearing means 35 and 36 absorb a thermal expansion in the vertical direction by rotation of a swivel arm 38, which is disposed in the support structure, about a pivot point 37 (FIG. 11), thereby compensating for the thermal expansion in the vertical direction. The bearing means 36 additionally provides, via one possibility of the shifting, for the compensation of thermal expansions in the horizontal direction. The thermal expansions at the flow grating 28 that are to be compensated for, and as a consequence thereof the shifting that occurs, are indicated by arrows.

Supporting the flow grating 28 in a support structure 29 that is disposed externally of the channel 1 enables the use of vibration dampeners 30 as well as the use of additional constant suspensions 31 to assist the support structure 29, which permits a design without additional cooling of the flow grating.

Figure 11:
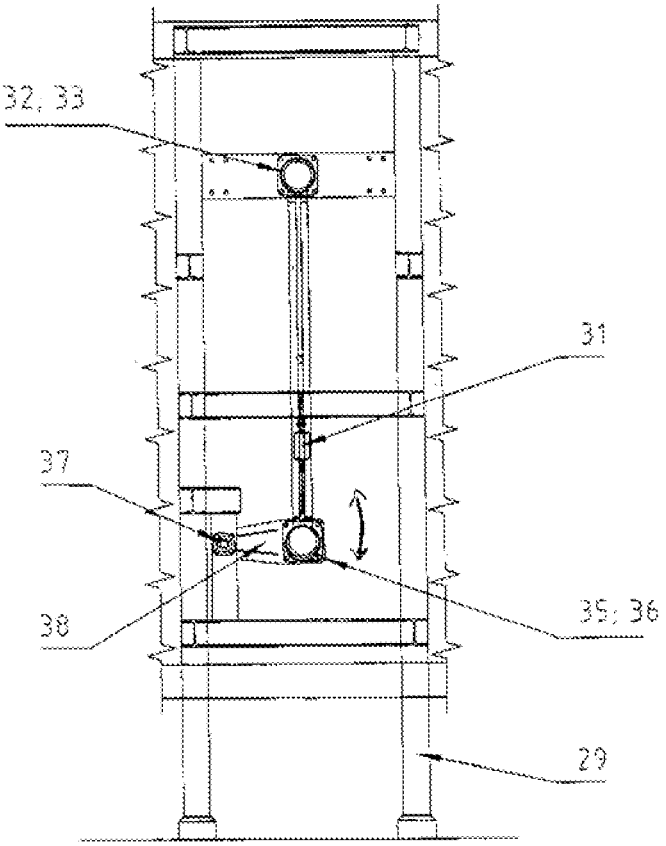
FIG. 11 is a side view of FIG. 10.

FIG. 11 shows a side view of the embodiment of FIG. 10, where one can clearly see the bearing means 32, 33 for the upper connecting element, and the bearing means 35, 36 for the lower connecting element, and the constant suspensions 31. Furthermore, one can clearly see the swivel arm 38 on the bearing means 36 of the lower connecting element, which pivots about the pivot point 37, which is indicated in two directions by the illustrated arrow.

The specification incorporates by reference the disclosure of European application 09014442.9 filed Nov. 19, 2009, as well as International application PCT/EP2010/007014, filed Nov. 18, 2010.

The present invention is, of course, in no way restricted to the specific disclosure of the specification and drawings, but also encompasses any modifications within the scope of the appended claims.

The invention claimed is:

1. An arrangement for influencing the flow of an exhaust gas of a gas turbine in a channel, comprising: a flow grating disposed transversely in the channel at an end of the channel that faces the gas turbine, wherein said flow grating continually partially obstructs the cross-sectional area of the channel, and wherein said flow grating is provided with passages, wherein the channel conveys the exhaust gas to a waste-heat exchanger or boiler further downstream of said flow grating; and a support structure, wherein said flow grating is connected to said support structure, further wherein said support structure is provided with support pipes or support rods, wherein link members pivotably securing one side of the support structure to an additional support longitudinally offset from a plane containing the flow grating, said plane transverse to the channel longitudinal axis, said additional support pivotably mounting on a wall of the channel, and wherein said support pipes or support rods are guided beyond the channel and are pivotably mounted on a wall of the channel.

2. An arrangement according to claim 1, wherein said support pipes or support rods are mounted in a vibration-dampening manner.

3. An arrangement according to claim 2, wherein externally of the channel, said support pipes or support rods are supported on a foundation.

4. An arrangement according to claim 1, wherein said support pipes or support rods are supported on a framework or structure that surrounds the channel.

5. An arrangement according to claim 1, wherein said support pipes or support rods are supported in a thermally-movable manner on a foundation or on a framework or structure.

6. An arrangement according to claim 1, wherein said support pipes or support rods are sealed relative to the channel via compensators.

* * * * *